United States Patent [19]

Stanzel

[11] 4,011,684

[45] Mar. 15, 1977

[54] CONTROL MECHANISM FOR MODEL AIRCRAFT

[76] Inventor: Victor Stanzel, Schulenberg, Tex. 78956

[22] Filed: June 2, 1975

[21] Appl. No.: 582,590

[52] U.S. Cl. ..... 46/77; 74/89; 74/89.15

[51] Int. Cl.[2] ..... A63H 27/04

[58] Field of Search ..... 46/77

[56] References Cited

UNITED STATES PATENTS

| | | | |
|---|---|---|---|
| 2,236,348 | 3/1941 | Stanzel | 46/77 |
| 2,558,109 | 6/1951 | Stanzel | 46/77 |
| 2,837,864 | 6/1958 | Bortfeldt | 46/77 |
| 3,018,585 | 1/1962 | Stanzel | 46/77 |

*Primary Examiner*—F. Barry Shay
*Attorney, Agent, or Firm*—Vinson and Elkins

[57] ABSTRACT

A torsional control system for model aircraft is disclosed in which a torsional control line extends from the aircraft to a control handle for rotating the control line, and carries all tensional forces between the aircraft and handle. A flexible shaft has one of its ends attached to the control line at a point spaced from the control line's attachment to the aircraft and the other end attached to a control device on the aircraft adapted to be operated by rotation of the flexible shaft means. Rotation of the control line by the control handle produces a proportional rotation of the flexible shaft and control device without subjecting the control device to line tension in the control line. This abstract is not to be construed in any way to define or limit the invention set forth below.

9 Claims, 7 Drawing Figures fig.4
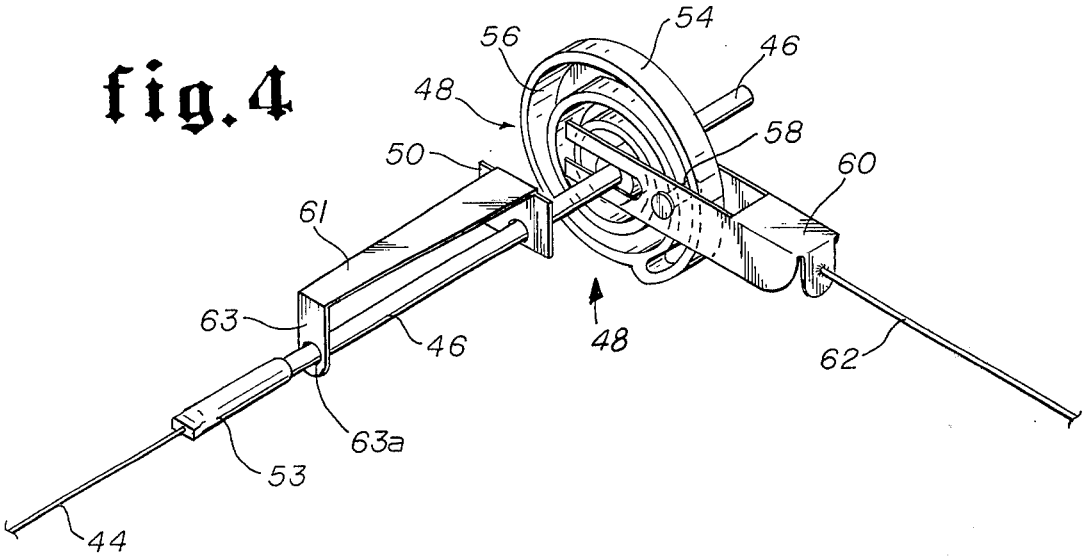
fig.5
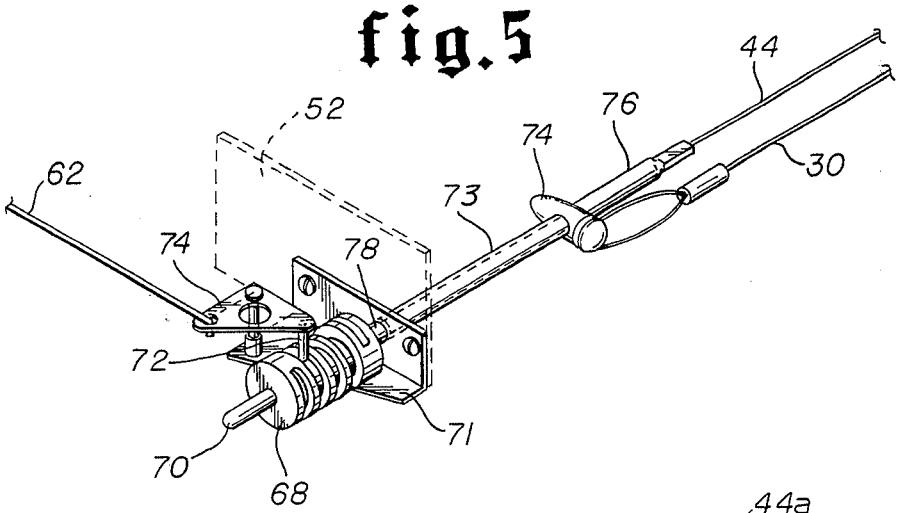
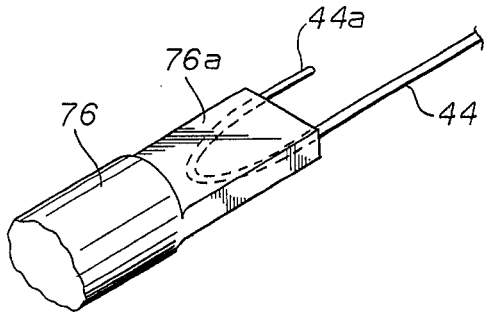
fig.6

CONTROL MECHANISM FOR MODEL AIRCRAFT

This invention relates to controlling means for model, or miniature, aircraft, particularly of the type which are self-propelled and self-sustaining in flight by the use of engines such as internal combustion or electrical engines. Such aircraft are normally controlled in flight by means of one or more control lines extending from a handle held by the flier of the aircraft to some point of attachment on the aircraft itself. Such a control confines the aircraft to an approximately circular flight pattern by reason of the constraining action of the control lines. The aircraft rudder is usually set outwardly prior to take off to maintain a slight outward thrust in the circular flight pattern of the aircraft and no control of the rudder during flight is necessary. In-flight control of the aircraft elevator is commonly provided, however, so that the vertical attitude of the aircraft may be properly controlled during take off, landing and during flight, and the aircraft made to perform stunts, manuvers, etc.

In the prior art the most common type of in-flight control for the aircraft elevator is provided by using a double control line extending from the handle to the aircraft and connected in the aircraft to a bell-crank type of control mechanism for operating the aircraft elevator controls, depending on the degree of relative tension applied in the two control lines by manipulation of the handle. While this type of control mechanism has been successfully used for many years, it is somewhat undesirable since, by reason of requiring two control lines, it becomes easily entangled and also increases the weight and air drag on the aircraft. Additionally, it results in almost total loss of control if the control lines become slack during flight.

A single line torsional control system, as shown and described in U.S. Pat. No. 2,558,109 issued June 26, 1951, overcomes many of the disadvantages of the old two-line bell-crank control by eliminating the dual control line and by maintaining control through torsion in the single control line so that control is not lost if a line becomes temporarily slack.

The single line torsional control system according to U.S. Pat. No. 2,558,109 consists of a control device mounted within the structure of the aircraft having a cam fixed on a rotatable shaft. A cam follower, engaging the cam, is connected to the control surface (normally the elevator) by a push-rod operating a control horn. The cam arrangement holds the control surface firmly positioned and prevents it from being moved or displaced by action of air flow thereover. A steel wire control line, preferable of music wire, is directly operatively connected to the control unit. A control handle, having a shaft manually actuated by the flier, is operatively connected to the other end of the control line. Normally the control handle is actuated to turn the shaft clockwise and counterclockwise by moving a control actuator back and forth . . . back for "up" control and forward for "down" control. As the control line is rotated clockwise, torsional force is applied to move the control surface in one direction. Reversely, when the line is rotated counterclockwise, the control surface is moved in the opposite direction.

Such former single line torsional control systems possessed a distinct disadvantage, however, in that the single control line was operatively connected directly to the control device for transforming torsion in the line to movement of the aircraft elevator. Because of the lineal tension in the control line generated by the centrifugal force of the aircraft, which tension was transmitted directly to the working shaft of the elevator control device, it was of utmost importance that the control line running through the lateral guide required in this type of control system be in precise axial alignment with the shaft of the elevator control device to prevent binding or jamming between the shaft and its bearings due to side pressure. Although the system worked perfectly with absolute axial alignment of the control line and shaft, only slight misalignment of these two components would cause the device to jam. Such misalignment could result from out-of-line mounting of the control device or the lateral line guide in construction, or from deflection of the wing carrying the lateral line guide.

Former single line torsional control devices also required a resistive or counter-torque member, acting against the torque transmitted by the control line as a means for selective positioning of the control surfaces. As torque in the control line, increased by action of the control handle, was transmitted to the control device, the resistive member would yield, causing the control mechanism to turn in one direction, clockwise or counterclockwise. Conversely, as the torsion in the control line was decreased or reversed by the control handle, the resistive member would cause the elevator control device to turn in the opposite direction. By reason of the necessity of the counter balancing torque member and the necessity for precise axial alignment of the parts, manufacture of this type of single line control device was quite expensive and the cost prohibited its use in popular priced flying model aircraft.

It is accordingly the primary object of this invention to provide a simplified single line torsional control system for model aircraft which overcomes the disadvantages of prior art single line control systems.

Another object is to provide such a system which may be used to control the aircraft elevator, or other control surfaces, or to control other factors, such as engine speed.

Another object is to provide such a control system wherein the control line is attached to the aircraft at some point other than to a movable part of the control device, whereby the movable parts of the control device are not subjected to control line tension.

Another object is to provide such a control system wherein a flexible shaft, essentially free of control line tension, is used to transmit torsional or rotative movement from the torsional control line to the control device on the aircraft.

Another object is to provide a control mechanism which eliminates the need for a counter torque member on the control device by utilizing a flexible shaft attached in a non-rotative relationship to the aircraft control line at a given point from the control line's fixed connection to the aircraft, which flexible shaft transmits rotational movement from the control line to the elevator control device without substantial torque generation.

Another object is to provide such a control system wherein the connection of the control device to the flexible shaft includes lost motion means for insulating the control device from any tensional forces transmitted by the flexible shaft.

Another object is to provide such a control system including a novel cam and cam follower arrangement which is simpler and less expensive to construct than prior art devices.

These and other objects and advantages of the invention will become apparent from the following specification, drawings and claims. In the accompanying drawings, in which like numerals indicate like parts:

FIG. 4 is an enlarged perspective view of the control device of FIG. 3;

FIG. 5 is an enlarged perspective view of an alternate embodiment of the control device of the invention which utilizes a horizontal spiral cam;

Figures 1, 2, 7:
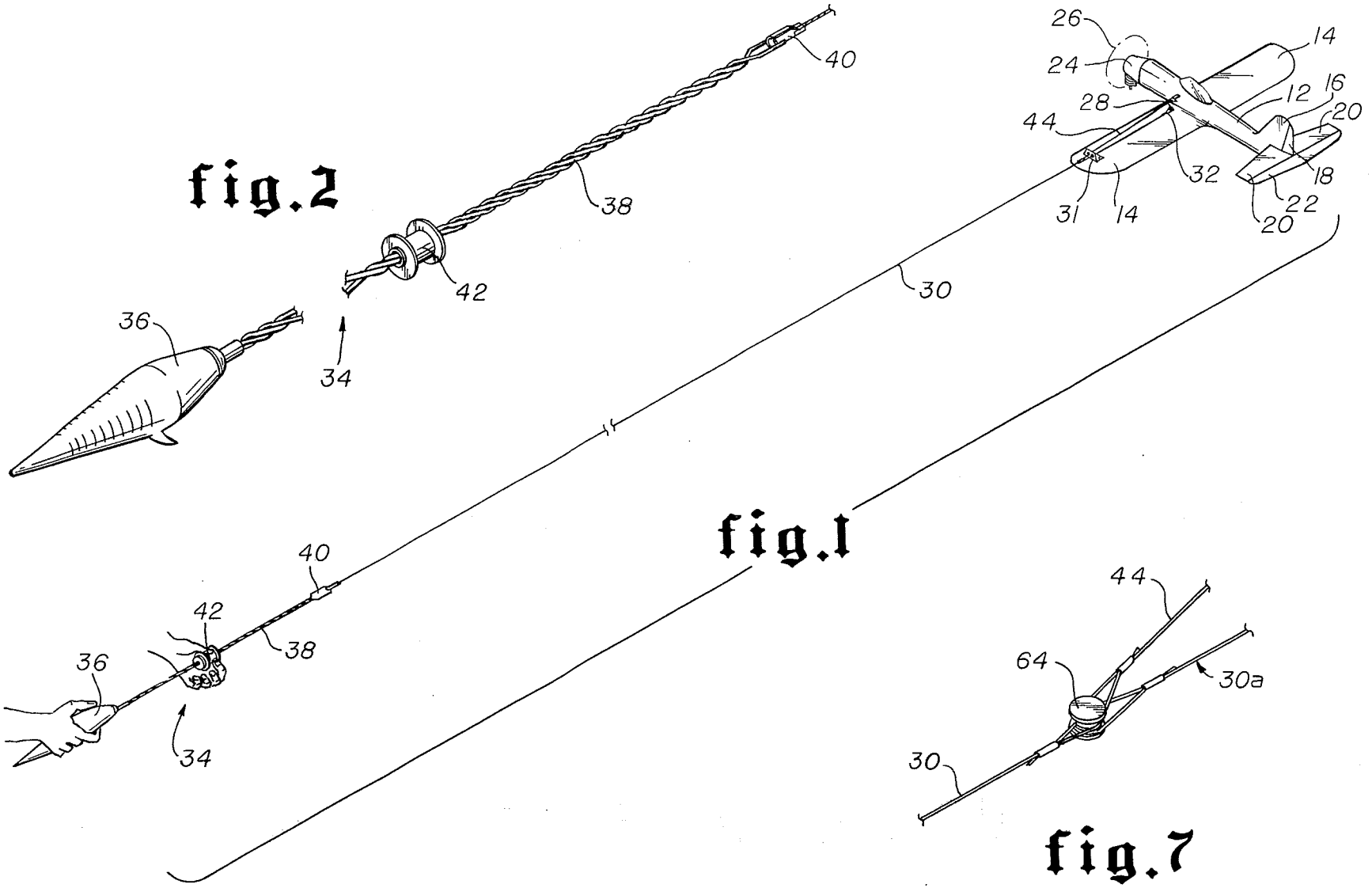
FIG. 1 is a somewhat diagramatic illustration in perspective of a model aircraft in flight utilizing the single line torsional control mechanism of the present invention and showing the control handle used by the aircraft flier for generating rotative movement of the lower end of the control line.
FIG. 2 is an enlarged perspective view of the control handle of FIG. 1.

FIG. 6 is an enlarged detail view of a portion of the control device of FIG. 5 illustrating the lost motion connection means between the shaft of the control device and the flexible shaft means; and FIG. 7 is an enlarged detail view of a portion of the torsional control line and of the flexible shaft means illustrating an embodiment in which the control line is formed in two sections of differing thickness to reduce the length of the flexible shaft means.

Referring now to FIG. 1 there is shown a model aircraft 10 including a fuselage 12 with wings 14 fastened thereto a vertical tailfin 16 with rudder 18 and stabilizers 20 terminating in an elevator 22. The aircraft is self propelled by means of a motor 24, preferable of the internal combustion type, which drives a conventional propeller 26.

Numeral 28 designates a fixed anchor point on the aircraft body for attachment of a torsional control line 30. The anchor point 28 is here shown attached to one of the wings 14, but it may be provided by other points on the aircraft, or on the elevator control device, as disclosed hereinafter. The control line 30 is formed of spring steel, preferably straightened music wire, and is non-rotatably attached to the aircraft 10 at the anchor point 28 by means of an end loop 32 hooked onto a slotted fitting at the anchor point. Thus, the end of the control line 30 attached to the aircraft may not turn axially at its point of attachment, but may be readily disengaged for separate storage of the aircraft and control line. The control line extends through a guide 31 on the wing tip, to thereby lend lateral stability to the aircraft in flight, and thence to the control handle 34.

The lower end of the control line 30 is releasably attached to the control handle 34 which provides means for torquing, or rotating, that end of the control line in either a clockwise or counterclockwise direction. The control handle 34 preferably includes a plastic grip 36 which may be held in one hand of the aircraft operator and an elongated twisted wire shaft 38 which is rotatably journaled in the grip 36. The twisted wire shaft 38 terminates in a slotted fitting 40 into which the lower end of the control line 30 may be removably received and held in non-rotating relationship with respect to the wire shaft 38 so that it will rotate with the shaft 38. A control knob 42 is provided on the wire shaft 38 in threaded relationship so that the wire shaft 38 may be made to rotate, either clockwise or counterclockwise, with respect to the stationary grip 36 by moving the control knob back and forth along the twisted wire shaft 38. In this manner the lower end of the control line 30 may be torqued, or rotated, in either a clockwise or counterclockwise direction as desired by the aircraft operator to thereby control operation of a control device on the aircraft. The control device may be used to control positioning of the elevator 22, or another movable flight control surface such as wing flaps, or to control any other desired function, such as engine speed.

Figure 3:
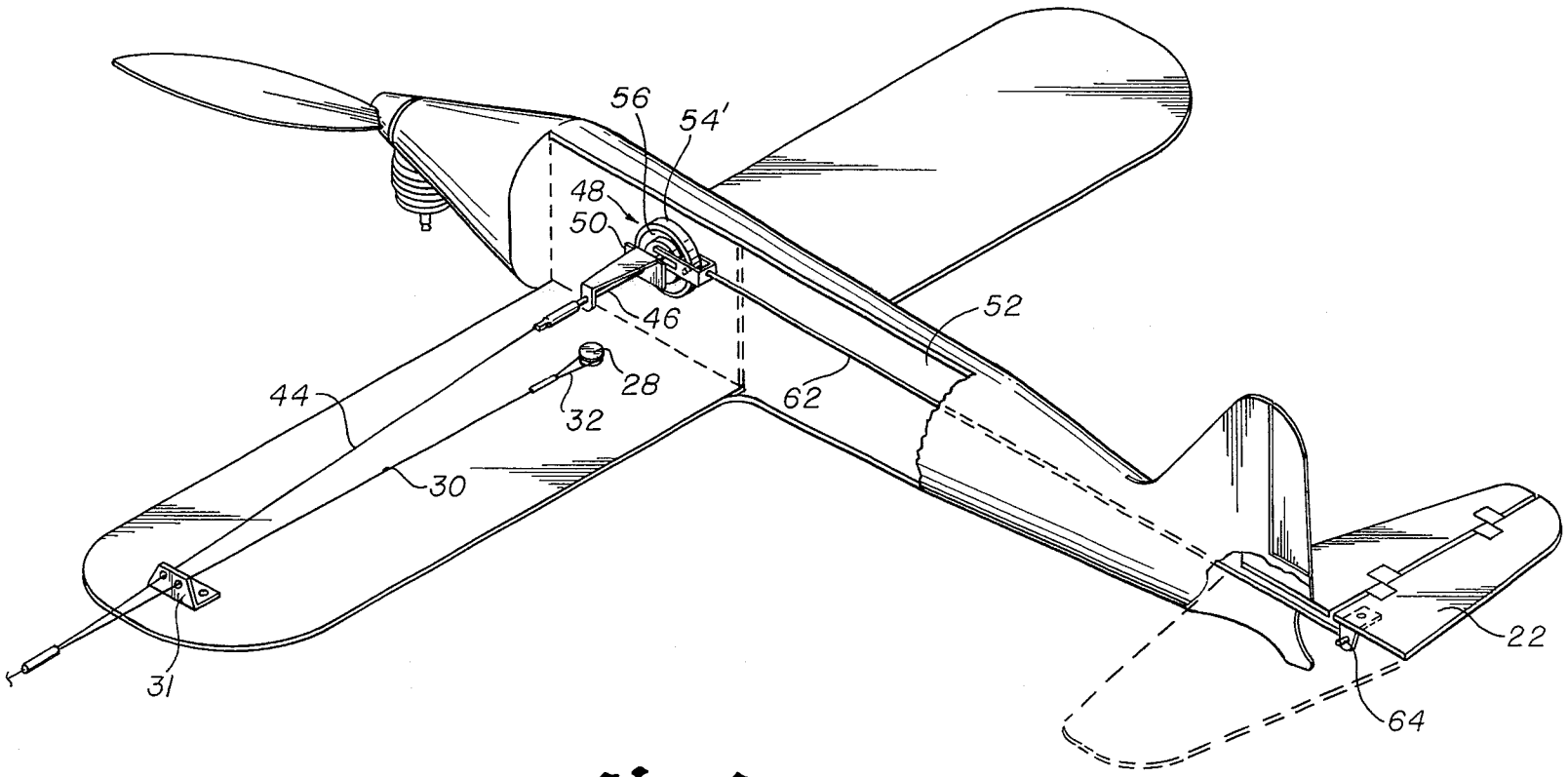
FIG. 3 shows a perspective view of a model aircraft partly broken away to show the control device adapted to be actuated by the torsional control line and flexible shaft means, said control device including a cam and cam follower for the transformation of rotational motion of the flexible shaft means to push and pull actuation of an elevator control rod.

A flexible shaft means 44, also preferably of music wire, is non-rotatably attached to the control line 30 at a point intermediate the control line's attachment to the aircraft and to the control handle 34. As shown hereinafter, the point of attachment is subject to considerable variation, but in any event the point at which the flexible wire shaft 44 is attached to the control line 30 will be relatively closer to the aircraft 10 than to the control handle 34. The point at which the flexible wire shaft 44 is attached to control line 30 may be within the wing span of the aircraft, so that only the control line 30 passes through the lateral guide 31 on the aircraft wing tip. Alternatively, the flexible wire shaft may be attached at a greater distance from the aircraft so that both the flexible wire shaft 44 and control line 30 pass through the lateral guide 31 on the wing tip, as illustrated in FIG. 3. In this event, the two wires may pass through separate holes in the guide 31, as illustrated, or through a single hole if preferred.

The other end of the flexible wire shaft 44 is non-rotatably attached to the shaft 46 of a control device 48 carried within the aircraft fuselage. In the preferred embodiment as illustrated, the control device 48 is used for control of the elevator 22. In its simplest form, the elevator control device 48 consists of a stamped metal base 50 adapted to be rigidly attached to the aircraft structure, such as the vertical rigidifying member 52. The base 50 has means for rotatably mounting the shaft 46 which extends transverse to the aircraft's longitudinal axis. At the outer end of the shaft 46 is provided a means 53 for non-rotatably attaching the flexible shaft means 44 and at the opposite end of the shaft 46 is provided a vertical disc-shaped cam 54 with a spiral cam slot 56 therein. A cam follower 58 engages the spiral cam slot and is attached to a slider 60 which slidably rides on the shaft 46 on either side of the cam 54. The slider 60 is connected to the aircraft control surface (normally the elevator 22) by a push rod 62 actuating a control horn 64 on the elevator 22. Thus, as the shaft 46 and cam 54 are rotated by the flexible wire shaft 44, the slider 60 and push rod 62 are moved back and forth with respect to the cam 54 by reason of the cam follower 58 following the spiral cam slot 56. The back and forth movement of the push rod 62 moves the control surface 22 up and down to thereby control the vertical orientation of the aircraft.

Lost motion means are preferably provided for mounting the control device 48 for limited movement axially of the shaft 46 so as to insulate it from any tensional force transmitted by the flexible shaft means 44. As shown such means may comprise a bracket 61 extending outwardly from mounting plate 50 with a downwardly extending ear 63 having an opening 63*a* therein for receiving the shaft 46 of the control device 48. With the shaft 46 extending through openings in the mounting plate 50 and ear 63 it is confined axially only by the attachment means 53 at one end and the cam 54 and slider 60 at the other and may slide axially as necessary to relieve tensional forces. Since the cam 54 is vertically oriented, such axial movement will have little, if any, effect on the operation of the cam follower 58 and push rod 62.

Rotation of the flexible wire shaft 44 to control operation of the control device 48 is accomplished by torquing, or rotating, the lower end of the control line 30 by means of the control handle 34. The amount of rotative action transmitted from the control line 30 to the control mechanism 48 is determined by the ratio of the total length of control line 30 to the length of the portion of the control line 30 between the control line's fixed attachment to the aircraft and the point of attachment of the flexible shaft 44. For example a 30 foot long control line having the flexible shaft 44 non-rotatably attached to it at a point 2 feet from the control line's fixed connection to the aircraft (anchor point 28) will rotate the control mechanism 48 one turn when the control handle end of the line 30 is rotated 15 turns. This is based on the fact that each foot of length of the 30 foot long control line will turn one half of a revolution when the control handle end of the line is revolved 15 turns. Therefore, at a point 2 feet from its fixed connection to the aircraft, the control line will revolve one turn, which is then transmitted to the shaft 46 of the control mechanism 48 by the flexible shaft 44. While the relationship between revolutions of the control line 30 and of the control device 48 are theoretically exact, in actual practice, it is necessary to rotate the lower end of the control line 30 an additional two or three turns to generate the additional torsional force necessary to overcome the friction in the control mechanism 48.

Thus, relatively accurate positioning of the control surface 22 may be accomplished by the aircraft operator by moving the control knob 42 forward or back along the twisted wire shaft 38 to rotate the lower end of the control line 30 an amount proportional to the amount of movement of the control surface 22 which is desired.

Since the control line 30 is directly attached to both the control handle 34 and the aircraft 10, it carries directly all tensional forces generated by the centrifugal force of the aircraft, without transmitting such tensional forces to the control mechanism 48. The control mechanism 48 may be further insulated from tensional forces by appropriate lost motion connection means as hereinafter described. Also, since the flexible wire shaft 44 is merely transmitting rotational movement from a point on the control line 30 to the shaft 46 of the control device 48, flexible shaft 44 will rotate freely, except for any frictional resistance in the control device. Therefore essentially no torsional forces are generated in the flexible shaft 44 and the control device 48 will therefore remain at rest at any position without the need for complicated counter-torque generating springs or similar devices.

If desired, the length of the flexible wire shaft 44 and the distance from the aircraft at which it is connected to the control line 30 may be substantially shortened by reducing the diameter of the portion of the control line 30 near its fixed point of connection to the aircraft to reduce its torquing resistance and concomitantly increase its proportional revolutions.

As shown in FIG. 7, the control line 30 may be formed in two sections, the main section 30 extending to the control handle 34 and a second section 30a extending only from the aircraft to the point at which the flexible wire shaft 44 is connected to the control line. For convenience in assembly and disassembly, it may be desirable to provide a disconnect near the juncture of the control line sections 30 and 30*a* and the flexible shaft 44. This can be accomplished by providing elongated loops at the juncture ends of the various lines and joining them with a slotted fitting 64.

By reducing the diameter of the aircraft-end of the control line 30, the length of the wire shaft 44 may be substantially reduced without loss of control. For example, in using a 30 foot long 0.016 inch diameter control line it is necessary to attach the flexible shaft 44 to the control line approximately 2 feet from its point of connection to the aircraft to obtain a control of one full revolution clockwise or counterclockwise for 15 revolutions of the lower end of the control line 30 in either direction. However, by reducing the aircraft-end section 30*a* of the control line 32 to a diameter of 0.012 inch, approximately the same amount of control may be had with the flexible shaft attached only 1 foot from the point at which the control line is attached to the aircraft. This length can be further reduced by using a multiplicity of smaller diameter wires between the fixed control line attachment to the aircraft and the point at which the flexible shaft is attached.

In FIGS. 5 and 6 are shown an alternate embodiment of the control device which takes up less space and may, if desired, be mounted entirely within the aircraft structure to reduce drag, as for example in speed or racing aircraft. This alternate embodiment uses a worm-type cam 68 mounted for rotation with a shaft 70 extending through mounting plate 71. The cam 68 is engaged by a cam follower pin 72 carried by a bell crank 74 pivotally mounted on plate 71. The push rod 62 is attached to the opposed apex of the bell crank so that lateral movements of the cam follower 72 are transformed into longitudinal movements of the push rod 62 for control of the elevator 22.

Since with this type of apparatus lateral movement of the cam 68 itself would also be transformed to longitudinal movement of the control surface push rod 62, it is desirable to use an alternate type of lost motion connection for the control device which avoids axial or lateral movement of the cam 68 and shaft 70. This may be provided by housing the cam shaft 70 within a concentric cylindrical housing 73 which terminates in a fitting 74 which may serve as the anchor point for control line 30. A stop 76 at the end of cam shaft 70 prevents movement of the cam shaft and cam inwardly. A flange 78 on the cam 68 engages the mounting plate 71 to prevent outward axial movement. The control device is still insulated against tensional force transmission by wire shaft 44 however, by providing a hollow rectangular extension 76*a* on the end of stop 76 into which a U bend 44*a* on the end of wire shaft 44 is inserted, so that it may slide back and forth a distance sufficient to provide the lost motion connection between the stop 76 and the shaft 44 but will still transmit rotational movement at all times.

Using this alternate embodiment of the control device, in combination with the means discussed above for shortening the distance at which the flexible wire shaft 44 is connected to the control line 30, it would be possible to house the entire control device and flexible shaft means 44 within the fuselage and wing structure of an aircraft, so that only the control line 30 would pass out of the structure through a single guide in the wing tip.

The foregoing disclosure and description of the invention are illustrative and explanatory thereof, and various changes in the size, shape and materials, as well as in the details of the illustrated construction may be made within the scope of the appended claims without departing from the spirit of the invention.

What is claimed is:

1. In a self-supporting model aircraft of the type wherein control of the aircraft about its lateral axis is accomplished by means of movement of a control surface on the aircraft, the improvement which comprises:

a control device on said aircraft for controlling movement of said control surface;

a control line capable of transmitting torsional force having one end non-rotatably attached to said aircraft and the other end attached to a control handle for rotating said control line; and a flexible shaft means having one end non-rotatably attached to said control line at a point intermediate said control line's attachment to said aircraft and to said control handle and the other end non-rotatably attached to said control device, whereby torsional forces for controlling said aircraft are transmitted through said control line and flexible shaft to said control device for controlling movement of said control surface.

2. The aircraft according to claim 1 wherein means are provided for insulating said control device against tensional forces transmitted by said flexible shaft means.

3. The aircraft according to claim 2 wherein said means for insulating said control device against tensional force comprise lost motion means for mounting said control device on said aircraft.

4. The apparatus according to claim 2 wherein said means for insulating said control device from tensional forces comprise lost motion connection means between said flexible shaft means and said control device.

5. An apparatus comprising:

a self-propelled model aircraft including a movable control surface thereon for controlling said aircraft in flight;

a control device on said aircraft for controlling movement of said control surface;

means on said aircraft for non-rotatably attaching a torsional control line thereto;

a control handle adapted to be held by the aircraft operator and including means for rotating the end of a torsional control line;

a torsional control line adapted to extend between and co-act with said attachment means and said control handle; and flexible shaft means adapted to be non-rotatably connected at one end thereof to said torsional control line at a point intermediate said attachment means and said control handle and to be non-rotatably attached at the other end thereof to said control device, for transmitting rotational movement and torsional force from the point of attachment to said control line to said control device.

6. The apparatus according to claim 5 wherein said control device comprises, a cam shaft extending transverse to the longitudinal axis of said aircraft and adapted to be rotated by said flexible shaft means, a cam non-rotatably fixed to said cam shaft, and a cam follower in engagement with said cam and connected to said control surface, whereby rotational movement of said cam is transformed into lineal movement of said cam follower to control movement of said control surface.

7. The apparatus according to claim 6 wherein said cam comprises a vertical disc having a spiral groove therein and wherein said cam and shaft are mounted on said aircraft for limited movement axially of said cam shaft to insulate said control device from any tensional force transmitted by said flexible shaft means.

8. The apparatus according to claim 6 wherein said cam includes a horizontal spiral cam surface and comprising additionally lost motion connection means between said cam shaft and said flexible shaft means permitting limited axial movement of said flexible shaft means relative to said cam shaft to thereby insulate said control device against tensional forces transmitted by said flexible shaft means.

9. An apparatus comprising:

a model aircraft;

a control device on said model aircraft including movable parts adapted to be actuated by rotational motion thereof for operating said control device;

a control line having one end thereof attached to said aircraft at a point other than to the movable parts of said control device;

a control handle adapted to be attached to the other end of said control line for rotating said control line; and flexible shaft means adapted to be non-rotatably attached at one end thereof to said control line at a point intermediate said control line's attachment to said aircraft and to said control handle and adapted to be non-rotatably attached at the other end thereof to a movable part of said control device for actuating the same, whereby tensional forces between said aircraft and said control handle are carried by said control line and rotational motion is transmitted from said control line through said flexible shaft means to said movable parts of said control device.

* * * * *